US005077993A

United States Patent [19]

Blair et al.

[11] Patent Number: 5,077,993

[45] Date of Patent: Jan. 7, 1992

[54] ELECTRICAL POWER METER BOX LOCKS

[75] Inventors: Richard W. Blair; Jack R. Grant, both of Houston, Tex.

[73] Assignee: Houston Industries Incorporated, Houston, Tex.

[21] Appl. No.: 561,953

[22] Filed: Aug. 2, 1990

[51] Int. Cl.[5] ..... E05C 19/06

[52] U.S. Cl. ..... 70/161; 70/164; 292/86; 292/91

[58] Field of Search ..... 70/164, 161, DIG. 34; 292/86, 91, 303, 19, 318, 322, DIG. 11

[56] References Cited

U.S. PATENT DOCUMENTS

| | | | |
|---|---|---|---|
| 578,786 | 3/1897 | Tiffany | 292/327 |
| 578,798 | 3/1897 | Wheelwright et al. | 292/327 |
| 620,219 | 2/1899 | Bogard | 70/232 |
| 1,067,549 | 7/1913 | Quigley | 70/232 |
| 1,188,886 | 6/1916 | Booth, Jr. | 292/327 |
| 1,309,382 | 7/1919 | Wilson | 292/19 |
| 1,344,048 | 6/1920 | Lombardo | 292/251 |
| 1,346,677 | 7/1920 | Porter | 292/251 |
| 1,553,188 | 9/1925 | Sauton | 292/307 |
| 1,664,820 | 4/1928 | Hughes | 292/251 |
| 1,782,584 | 11/1930 | Ryan | 70/232 |
| 2,008,104 | 7/1935 | Juvinall | 292/307 |
| 2,113,687 | 4/1938 | Grace | 292/86 X |
| 2,396,771 | 3/1946 | Brinson, Sr. | 292/19 X |
| 2,455,069 | 11/1948 | Launder | 70/77 |
| 3,039,802 | 6/1962 | Barry | 292/86 X |
| 3,157,040 | 11/1964 | Raye | 70/57 |
| 3,172,282 | 3/1965 | Heckrotte | 70/232 |
| 3,596,554 | 8/1971 | Low | 24/453 X |
| 3,602,017 | 8/1971 | Bauer | 292/86 X |
| 3,861,180 | 1/1975 | Heckrotte, Sr. et al. | 70/164 |
| 4,031,722 | 6/1977 | Michelman | 70/77 X |
| 4,057,935 | 11/1977 | Rohrberg et al. | 292/19 X |
| 4,075,742 | 2/1978 | Remark et al. | 292/307 X |
| 4,080,811 | 3/1978 | Nielsen, Jr. | 70/77 X |
| 4,144,729 | 3/1979 | Nielsen, Jr. | 70/63 |
| 4,254,647 | 3/1981 | Finck, Jr. | 70/77 |
| 4,329,860 | 5/1982 | Moberg | 70/164 |
| 4,406,358 | 9/1983 | Zahradnik | 70/159 X |
| 4,414,829 | 11/1983 | Nielsen, Jr. | 70/77 X |
| 4,415,190 | 11/1983 | Finck, Jr. | 292/256.6 |
| 4,418,952 | 12/1983 | Wallet | 292/327 |
| 4,945,738 | 8/1990 | Blair et al. | 70/161 |

*Primary Examiner*—Lloyd A. Gall
*Attorney, Agent, or Firm*—Pravel, Gambrell, Hewitt, Kimball & Krieger

[57] ABSTRACT

A lock for electrical power meter boxes has a solid rod with a flared head to engage spring steel blades to lock it. The lock has a spring loaded sleeve within a housing, which can be permanently mounted either inside or outside a meter box. The spring loaded sleeve is maneuverable by an unlocking tool to open and release the spring sheet blades from the locked position.

7 Claims, 6 Drawing Sheets

ELECTRICAL POWER METER BOX LOCKS

CROSS REFERENCE TO RELATED APPLICATIONS

The present application relates to electrical power meter box locks, as does copending U.S. patent application Ser. No. 436,343 now U.S. Pat. No. 4,945,379 of which Applicants are inventors, and which is commonly owned.

BACKGROUND OF THE INVENTION

1. Field of the Invention

The present invention relates to locks for an electrical power meter box.

2. Description of the Prior Art

Although in at least some jurisdictions to do so is a criminal act, unauthorized use of electrical power is a major problem for electric utilities. Detecting and prosecuting unauthorized use of electricity by commercial establishments is an expensive and difficult task. Certain businesses, such a supermarkets, have a generally constant load factor which can be monitored by computer to detect abrupt load increases or decreases. However, those who make unauthorized use from the beginning of electrical service cannot be detected by computer, since there is no prior history of electricity usage. Thus, unauthorized use may often only be detected by meter readers and other field personnel.

Commercial electrical power meter boxes, also commonly known in the industry as cans, have been manufactured the same basic way for many years. The boxes are comprised of a front half and a rear half, with the two halves being hinged together at the same surface, usually the top. To gain access to tap and use electricity without authorization, one need only open a meter box and close the master power switch. To protect against such unauthorized entry, tabs at an edge, commonly the bottom, of the box halves have in the past been held closed together with a wire seal. A broken seal indicated unauthorized entry into the meter box.

A meter reader making periodic power usage readings could then also inspect the seal to determine if it had been broken. If so, it is probable that unauthorized entry into the meter box was likely and that unauthorized use was being made of electrical power. However, the seal was located below the bottom face of the meter box approximately halfway between the front and back of the box.

For example, in U.S. Pat. No. 2,008,104 a bolt was inserted through the tabs in the lower face of a meter cover and secured with a nut. A seal was inserted through openings or apertures in the bolt and nut to prevent unauthorized access to the meter. The seal was, however, at the bottom of the meter cover, a location typically at or below waist level of a meter reader. Unless the meter reader was particularly thorough and took the extra time to check the seal, a broken seal could be undetected for some period of time.

Examples of other electric power meter locks are described in U.S. Pat. No. 4,031,722; U.S. Pat. No. 4,080,811; U.S. Pat. No. 4,144,729; U.S. Pat. No. 4,254,647; and U.S. Pat. No. 4,414,829. All of these patents provided locks for meter cans having an openable front cover. However, none of these locks were adapted to be used on commercial meter enclosure boxes nor did these locks locate the seal in an easily visible position.

Examples of locking ring assemblies for glass meter covers are found in U.S. Pat. No. 4,329,860 and U.S. Pat. No. 4,415,190. Examples of other types of locks are U.S. Pat. No. 1,067,549; U.S. Pat. No. 1,188,886; U.S. Pat. No. 1,665,820; U.S. Pat. No. 3,157,040; U.S. Pat. No. 3,172,282; and U.S. Pat. No. 4,406,358.

Although other types of locks were known in the art, none have proposed or suggested that they be used with electrical power meter boxes. For example, U.S. Pat. No. 4,075,742 related to an alternative locking mechanism in the form of a solid rod with a tapered head which is locked by a slit sleeve in a receiving casing. However, the locking device of this patent was designed as a disposable one which was purposely designed to be cut to be removed. Accordingly, such a locking device would be unsuitable for use on electrical power meter boxes.

U.S. Pat. Nos. 578,786 and 578,798 involved locks for a car seal which had to be rotated to be unlocked, but were not intended for use with electrical power meter boxes. U.S. Pat. No. 2,455,069 related to a lock with telescoping tubes provided with a mechanism for releasing latching engagement merely by pressing on a cylinder lock in one of the tubes. As such, this type of lock was not secure enough for use with electrical power meter boxes, since it was too easily unlocked.

Other examples of rod locks were U.S. Pat. Nos. 4,418, 952; 1,782,584; 3,596,554; 1,553,188; 1,346,677; 1,344,048; and 620,219.

SUMMARY OF THE INVENTION

Briefly, the present invention provides new and improved locks for commercial electrical power meter boxes consisting of front and rear halves. The locks may be mounted on any face of the meter box, on either the outside of the box or on the inside, so long as the front face of the lock is accessible from the outside of the meter box. The locks utilize a locking rod having a flared head which engages a steel leaf spring to lock the meter box. The lock can be unlocked by moving a sliding sleeve along the locking rod to the location of the flared head. This movement disengages the steel leaf spring from the flared head of the locking rod and allows the locking rod to be moved to an unlocked position so that access to the meter box is then permitted.

DESCRIPTION OF THE PREFERRED EMBODIMENT

Figure 1:
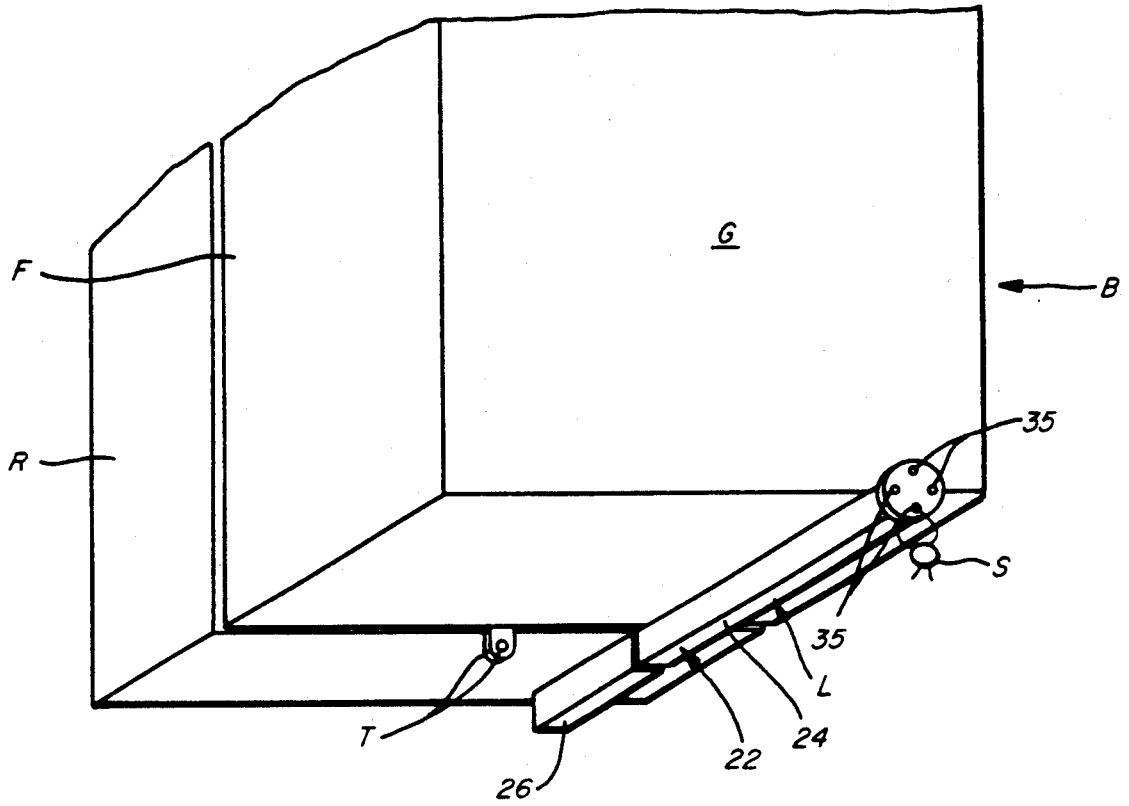
FIG. 1 is an isometric view of an installed electrical power meter box lock according to the present invention.

In the drawings, the letter L (FIGS. 1–8) designates generally an electrical power meter box lock according to the present invention for locking and locating a wire seal S in a visible area on an electrical power meter box B. The wire seal S is a conventional seal which is not reusable. Therefore, an unbroken seal indicates that the meter box B has not been tampered with by unauthorized persons.

The meter box B is a conventional commercial electrical power meter box typically in the form of two body portions or halves, such as a front half F and a rear half R. The body portions or halves are connected together at adjoining surfaces, such as the top, by a conventional hinge connection. The box halves F and R have like-shaped downwardly facing closure tabs T through which the seal S was previously typically inserted for protecting against unauthorized entry into the meter box B.

As illustrated in FIG. 1, the lock L readily shows if tampering with the seal S has occurred because the seal S is on face G of the box B. The components of the lock L are formed from a suitable strength steel or other suitable material. The lock L comprises a housing assembly 22 which is formed of a front housing 24 and a rear housing 26 which are mounted to the front half F and the rear half R of the meter box B, respectively. The front housing 24 is aligned with the rear housing 26 so that the front housing 24 registers with the rear housing 26 when the meter box B is closed; however, the front housing 24 completely separates from the rear housing 26 as the front half F is rotated to open the box B.

The housing assembly 22 is formed of square structural tubing in the preferred embodiment. The square tubing enables the housing assembly 22 to be easily connected to a flat surface of the meter box B such as the side or bottom of the box B by tack welding or by other suitable connecting means.

A flange 30 (FIG. 2) is mounted at an outer end 28 of the housing 24. The flange 30 has a suitable number of openings 31 formed therein through which a wire or wires of the seal S may be passed for the purpose of limiting access to the meter box B. The flange also has a central opening 32 for access by an unlocking key to the interior of the lock L. The opening 32 thus may have a diameter slightly smaller than the opening of the square front housing 24. The central opening 32 has internal threads 34 for connecting a connector cap C (FIG. 5) to the housing 24.

The connector cap C has a number of circumferentially spaced openings 35 and an inwardly extending threaded connector member 36 having external threads 37. The threads 37 mate with the internal threads 34 of the flange 30 so that the connector cap C can be mounted to the housing 24. With the connector cap C installed on front housing 24, the wire or wires of the wire seal S can then be inserted through the openings 31 and 35 and the seal S closed to prevent unauthorized access to the meter box B.

Figure 2:
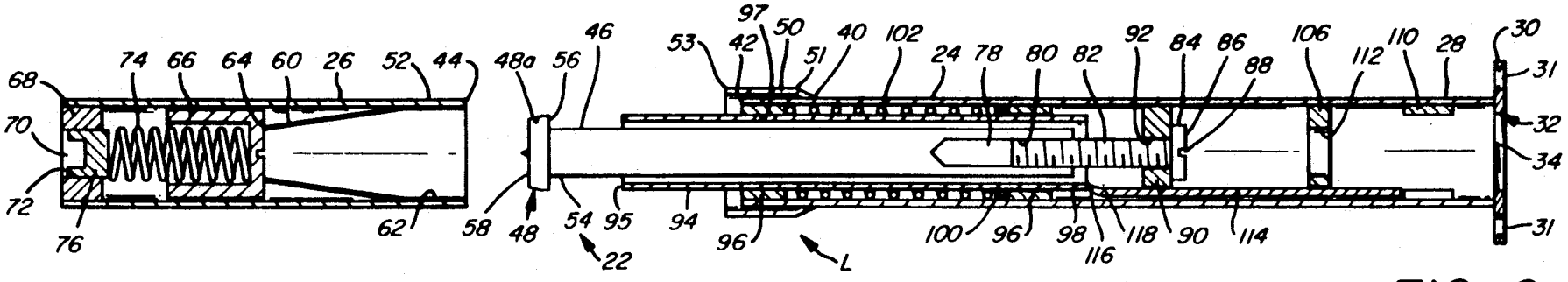
FIGS. 2, 3, 4, 5, 6, 7 and 8 are each elevation views, taken partly in cross-section, of an electrical power meter box lock in various operating positions.
Figure 3:
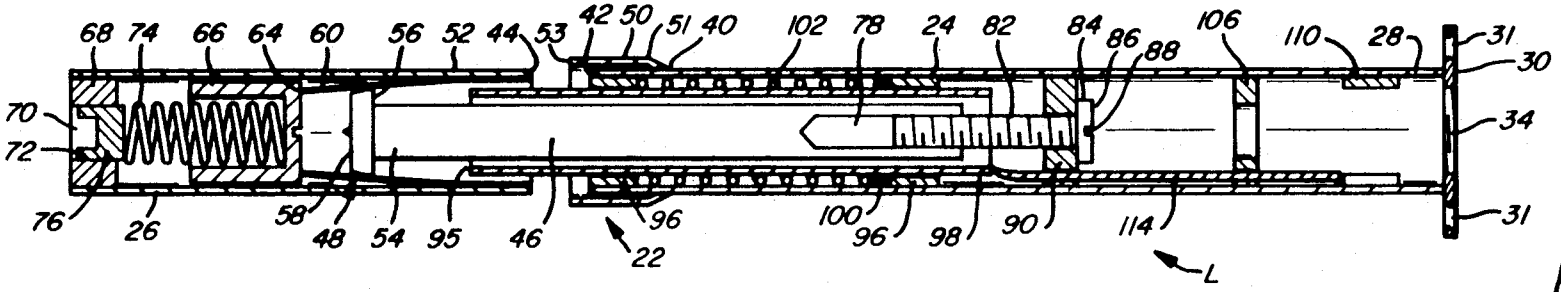
Figure 4:
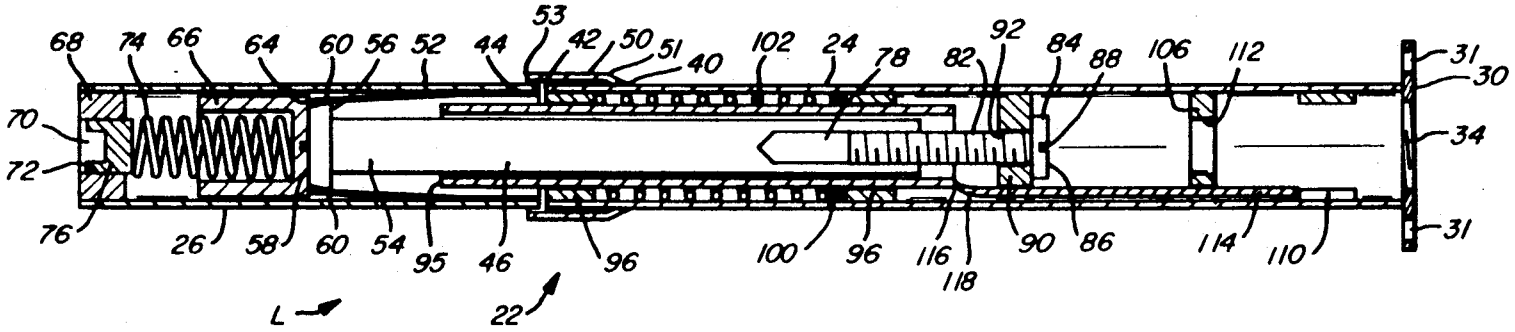

As shown in FIG. 2, the front housing 24 is provided with a mating edge 42 at its inner end 40, about which of extends a shield 50. Shield 50 is preferably formed of square structural tubing slightly larger in size than the front housing 24 so as to fit closely over the front housing 24. An outer end 51 of the shield 50 is welded in the preferred embodiment to the inner end 40 of the front housing 24, while an opposite end 53 of the shield 50 extends beyond the mating edge 42 to enclose an inner end 44 of an inner portion 52 of rear housing 26.

The length of the front housing 24 is generally equal to the depth of the front half F. In this manner, the flange 30 is located at or beyond the front face G of the box B. According to the present invention, at or beyond is intended to mean that a meter reader or other inspector can see both the wire seal S and the meter of the box B at the same time.

The lock L utilizes as a key mechanism a generally straight rod 46, preferably cylindrical in cross-sectional area, having a flared locking head 48 on a rear end 54. The locking head 48 has a flat, circular inner face 56 and a flat, circular outer face 58 with sides 48*a* of the locking head 48 being tapered outwardly from the outer face 58 to the inner face 56.

The rear housing 26 has spring steel blades 60 which are fixedly attached within the inner end 52 of the rear housing 26. The spring steel blades 60 are positioned on opposite sides of the inner end 52 from one another. Each spring blade 60 is attached to an inner surface 62 within the inner end of the rear housing 26. The blades 60 extend inwardly, as shown at an angle toward the center of the rear housing 26.

Each spring blade 60 has an end 64 which rests against a stop 66. The stop 66 is a U-shaped member as shown in the drawings, but it may also be cup-shaped, so long as it fits inside the rear housing 26. The stop 66 is adapted to travel in a sliding movement longitudinally within the rear housing 26. The rear housing 26 has a rear sealing plate 68 which prohibits access into the housing 26 and seals against moisture. The back plate 68 has a central opening 70 having internal threads 72. A stop spring 74 is positioned between the back plate 68 and the U-shaped stop 66. A threaded member 76, such as a slotted screw, is inserted in the internally threaded opening 70 of the back plate 68. The threaded screw 76 extends within the hollow core of stop spring 74 to maintain alignment of the stop spring 74 between the back plate 68 and the stop 66. The stop spring 74 forces the stop 66 against the blade ends 64 when the lock L is in the unlocked position (FIG. 2).

Figure 5:
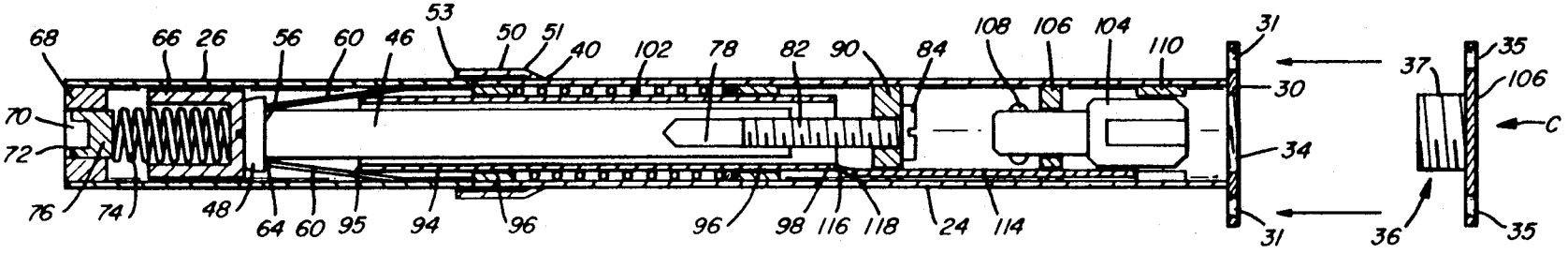

When locking the lock L, the locking head 48 of the lock rod 46 pushes up against stop 66 which slides rearwardly causing the stop spring 74 to compress. The spring steel blades 60 yield outwardly (FIG. 3 & 4) when contacted by locking head 48, permitting the locking head 48 to advance inwardly past the blade ends 64 (FIG. 5). As the locking head 48 advances beyond the blade ends 64, the blade ends 64 converge again inwardly towards one another. In this position the blade ends 64 engage an inner face 56 of the locking head 48. This serves to firmly engage the locking rod 46 within the rear housing 26, locking the lock L (FIG. 5).

The lock rod 46 has a front end 78 having a central threaded aperture 80 for receiving an adjustment screw 82. The adjustment screw 82 has a head 84 for permitting rotation of the screw 82 to adjust relative positions of the locking rod 46 to insure proper locking, as will be set forth. The head 84 of adjustment screw 82 is shown as having a flat outer surface 86 with a recessed groove 88 for engaging with an adjustment tool, such as a screwdriver. It should be understood that the recessed groove 88 may be cruciform, or X-shaped, according to the type of adjustment used. Various other key and groove mechanisms may also be used, if desired.

The adjustment screw 82 is threaded through a lock rod centering block 90 within the front housing 24. The lock rod centering block 90 has a central threaded aperture 92 within which the adjustment screw 82 is advanced.

An unlocking slide sleeve 94 is of a slightly larger diameter than the lock rod 46 and is placed over the lock rod 46. Two sliding sleeve centering blocks 96 are fixedly mounted within the front housing 24. The centering blocks 96 are attached to the front housing 24, each having a central aperture 97 of a diameter slightly greater than the unlocking slide sleeve 94. This allows the slide sleeve 94 to freely travel between the centering blocks 96 along the center axis of the front housing 24.

An inner one of the centering blocks 96 is located at the inner end 40 of the front housing 24, while a second or outer centering block 96 located near a front end 98 of the sliding sleeve 94. A sleeve ring 100 is attached to the outer perimeter of the slide sleeve 94. The outer dimensions of the sleeve ring 100 are smaller than the inside dimensions of the front housing 24 so that the sleeve ring 100 may travel inside the front housing 24. The sleeve ring 100 limits the forward advancement of the slide sleeve 94 by abutting the second centering block 96 located near the front end 98 of the sliding sleeve 94.

A sleeve retraction spring 102 has an inside core diameter slightly greater than the outer diameter of the slide sleeve 94 so that the retraction spring 102 may be positioned around the slide sleeve 94. The retraction spring 102 is positioned between the sleeve ring 100 and the sliding sleeve centering block 96 at the inner end 40 of the front housing 24. The retraction spring 102 serves to retract the slide sleeve 94 from the locking head 48 of the lock rod 46.

As a further protective measure, an additional security feature in the form of a cylinder lock 104 (FIG. 5) may be added to the lock L as shown in FIG. 5. The cylinder lock 104 is of the conventional, commercially available type and its inner details are not thus shown. Cylinder lock 104 is adapted to be inserted in the outer end 28 of the front housing 24 by passing it through the central opening 32 of the flange 30. The cylinder lock 104 is recessed inside the outer end 28 of the front housing 24 to prevent attempts to pry out cylinder lock 104.

A cylinder lock stop 106 is mounted inside the front housing 24 between the flange 30 and the lock rod centering block 90. The cylinder lock stop 106 serves as a movement barrier for cylinder lock 104. When cylinder lock 104 is in the proper position in lock L, the cylinder lock 104 may be locked by a conventional key inserted into a key slot (not shown) so that retractable locking beads 108 of cylinder lock 104 are firmly locked in the position shown in FIG. 5.

The cylinder lock stop 106 will not allow the locking beads 108 to pass through an aperture 112 (FIG. 2) in the lock stop 106 when the cylinder lock 104 is in the locked position. When cylinder lock 104 is unlocked, however, locking beads 108 are movable inwardly and are cammed inwardly by lock stop 106, permitting removal of cylinder lock 104 from lock L. A cylinder lock guide 110 is inserted between flange 30 and the cylinder lock stop 106. The cylinder lock guide 110 is sized to centralize and direct the cylinder lock 104 through the aperture 112 in the cylinder lock stop 106.

Figure 9:
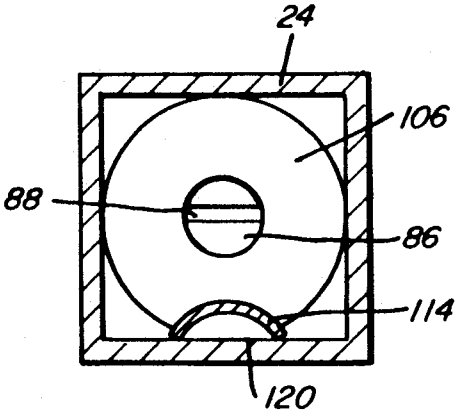
FIG. 9 is a view taken along lines 9—9 of FIG. 8.
Figure 11:
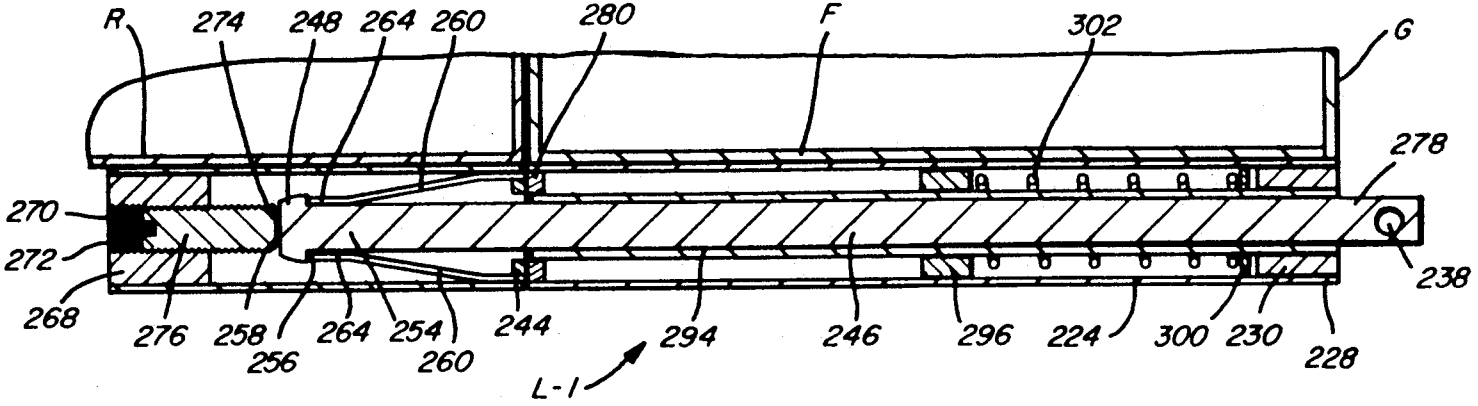
FIGS. 10, 11, 13, 14 and 15 are each elevation views, taken partly in cross-section, of an electrical power meter box lock according to another embodiment of the present invention.

An unlocking slide member 114 extends between the cylinder lock guide 110 and the front end 98 of the slide sleeve 94. The unlocking slide member 114 is a generally long, narrow, flat member having a raised toe 116 at an inner end 118. The lock rod center block 90 and the cylinder lock stop 106 each have a cut-out 120 to provide a passageway for the unlocking slide 114 to travel (FIG. 9).

Figure 6:
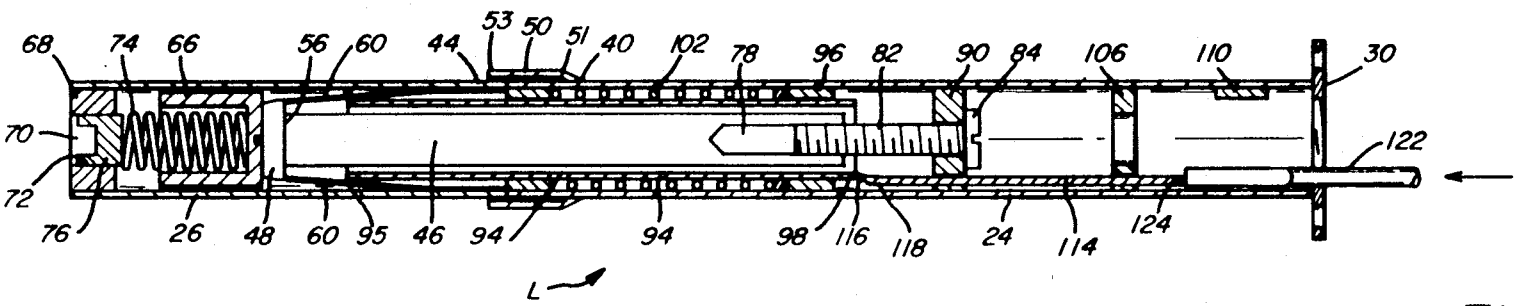
Figure 7:
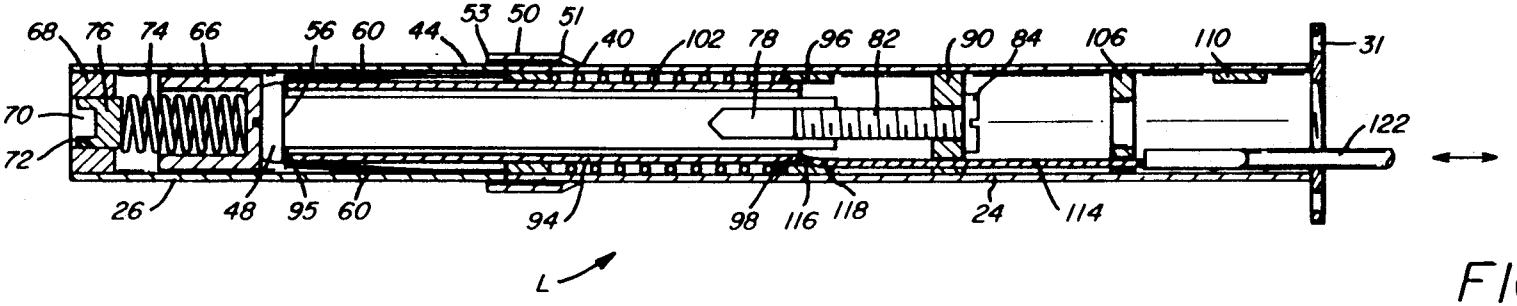

A tool 122, shown in FIGS. 6–7 as a flat screwdriver, contacts an outer edge 124 of the unlocking slide 114 which, when force is applied in the direction of the rear housing 26, causes the unlocking slide 114 to make contact (FIG. 6) with the front end 98 of the slide sleeve 94.

As shown in FIGS. 6 and 7, the continued application of force directed towards the rear housing 26 forces the inner edge 95 of the slide sleeve 94 towards the locking head 48 until the inner edge 95 contacts the inner face 56 of the locking head 48. The slide sleeve 94 expands the spring steel blades 60 from around the straight rod 46. This in turn permits the stop spring 74 to expand and force the locking head 48 past the blade ends 64 (FIG. 7) in the direction of the receiving edge 44 of the rear housing 26. At this point, the lock L is unlocked and the box B may be opened.

In use, the lock L is fixedly attached to the box B as previously described, either internally or externally. The straight rod 46 is adjusted so that the locking head 48 will automatically become engaged by the spring steel blades 60 when the meter box B is closed and the front housing 24 and the rear housing 26 abut one another. The straight rod 46 is adjusted by manually rotating the locking head 48 of the rod 46, while preventing rotation of the adjustment screw 82, until the required position of the rod 46 is attained. Once the rod 46 has been adjusted, no further adjustment should be necessary in the future.

After the box B is closed and the locking head 48 engaged within the spring blades 60, the cylinder lock 104 is inserted through the flange opening 32 and cylinder lock guide 110. The cylinder lock 104 is locked after the locking beads 108 have passed through the lock stop 106. The connector C is then screwed in the flange opening 32. The conventional wire seal S is then inserted through the openings 31 and 35.

The unlocking procedure involves removal of the conventional seal S and unscrewing the connector cap C. The cylinder lock 104 is removed after it is unlocked, releasing force on the locking beads 108, permitting the locking beads 108 to pass through the lock stop 106. As shown in FIG. 6, the unlocking tool 122 is inserted through the flange 30 and positioned against the outer edge 124 of the unlocking slide 114.

An operator forces the unlocking slide 114, which is free to slide, against the unlocking slide sleeve 94 with the tool 122. The continued application of force causes the unlocking slide sleeve 94 to advance towards the locking head 48 until the slide sleeve 94 makes contact with the locking head 48 (FIG. 7), the slide sleeve 94 disengaging the spring steel blades 60 from around the head 48 in the process.

Figure 8:
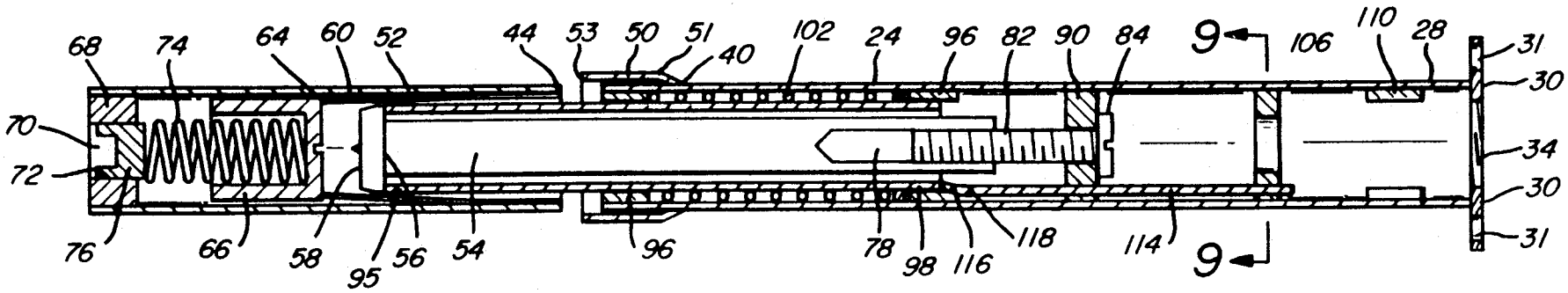

The stop spring 74 with stop 66 advances toward the blade ends 64 as the head 48 and unlocking slide sleeve 94 are withdrawn from the rear housing 26 (FIG. 8). The locking head 48 and the unlocking slide sleeve 94 withdraw from the rear housing 26 as the box B is opened.

An alternative electrical power meter box lock according to the present invention is shown in FIGS. 10, 11, 13–15 and is designated as L-1. Lock L-1 employs many of the same principles as lock L and can be used in the same types of applications as lock L.

Figure 10:
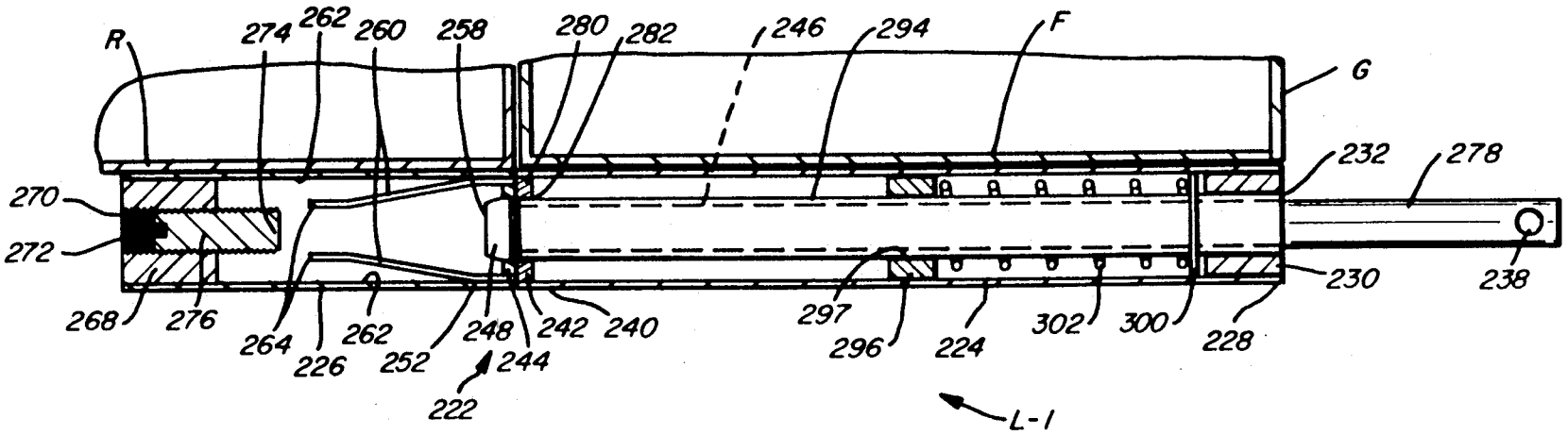

The components of the lock L-1 are formed from a suitable strength steel or other suitable material. The lock L-1 includes a housing assembly 222 which is formed of a front housing 224 and a rear housing 226 which are mounted to the front half F and the rear half R of the meter box B respectively as shown in FIG. 10. The front housing 224 is aligned with the rear housing 226 so that the front housing 224 registers with the rear housing 226 when the meter box B is closed; however, the front housing 224 completely separates from the rear housing 226 as the front half F is rotated to open the box B.

The housing assembly 222 is formed of square structural tubing in the alternate embodiment. The square tubing enables the housing assembly 222 to be easily connected to a flat surface of the meter box B such as the side or bottom of the box B by tack welding or other suitable connecting means. The front housing 224 has a plug 230 which is inserted and attached to an outer end 228 of the front housing 224. The plug 230 has a central opening 232.

The front housing 224 has a mating edge 242 at an inner end 240 of the front housing 224. The length of the front housing 224 is generally equal to the depth of the front half F. In this manner, the outer end 228 of the front housing 224 is located at or beyond the front face G of the box B. The rear housing 226 has a receiving edge 244 at a receiving end 252. The length of the rear housing 226 is a function of the operating mechanism of the lock L-1 as discussed below.

The lock L-1 utilizes a straight rod 246, preferably cylindrical in cross-sectional area, having a flared locking head 248 on the rear end 254 of the rod 246. The locking head 248 has a flat, circular inner face 256 and a flat, circular outer face 258 with the sides of the locking head 248 being tapered outwardly from the outer face 258 to the inner face 256.

A front/or outer end 278 of the rod 246 extends through the central opening 232 of the plug 230. The front end 278 of the rod 246 has an opening 238 therethrough. A conventional seal S is inserted through the opening 238 when the lock L-1 is in the locked position.

The rear housing 226 has one or more spring steel blades 260 which are attached to the receiving end 252 of the rear housing 226. FIGS. 10, 11, 13–15 show two spring steel blades 260 positioned opposite one another. Each blade 260 is attached to an inner surface 262 of the rear housing 226. The blades 260 incline inwardly as shown toward the center of the rear housing 226. Ends 264 of the blades 260 are freely positioned within a central area of the housing 226.

The distance between the free ends 264 of the blades 260 is generally the diameter of the straight rod 246. The rear housing 226 has a back plate 268 which seals off the housing 226 to moisture. The back plate 268 has a central opening 270 having internal threads 272.

A threaded member 276, such as a slotted screw, is inserted in the internally threaded opening 270 of the back plate 268. The threaded screw 276 extends through the back plate 268 and into the rear housing 226. A forward end 274 of the threaded screw 276 contacts the outer face 258 of the locking head 248 when the lock L1 is in the locked position. An unlocking slide sleeve 294 of a slightly larger diameter than the lock rod 246 is placed over the lock rod 246.

The inner end 240 of the front housing 224 has an inner end plate 280 having a central aperture 282 of a diameter slightly greater than the unlocking slide sleeve 294. A sliding sleeve centering block 296 is installed in the middle portion of the front housing 224. The centering block 296 is attached to the front housing 224 and has a central aperture 297 of a diameter slightly greater than the unlocking slide sleeve 294, thus allowing the slide sleeve 294 to freely travel through the centering block 296 and the inner end plate 280 along the center line of the front housing 224.

A sleeve ring 300 is attached to the outer perimeter of the slide sleeve 294. The outer dimensions of the sleeve ring 300 are smaller than the inside dimensions of the front housing 224 so that the sleeve ring 300 may travel inside the front housing 224. The sleeve ring 300 limits forward advancement of the slide sleeve 294 by abutting the plug 230 located at the outer end 228 of the front housing 224.

A sleeve retraction spring 302 has an inside core diameter slightly greater than the outer diameter of the slide sleeve 294, so that the retraction spring 302 may be positioned around the slide sleeve 294. The retraction spring 302 is positioned between the sleeve ring 300 and the sliding sleeve centering block 296. The retraction spring 302 serves to retract the slide sleeve 294 from within the rear housing 226 when the lock L-1 is in the unlocked position.

Figure 13:
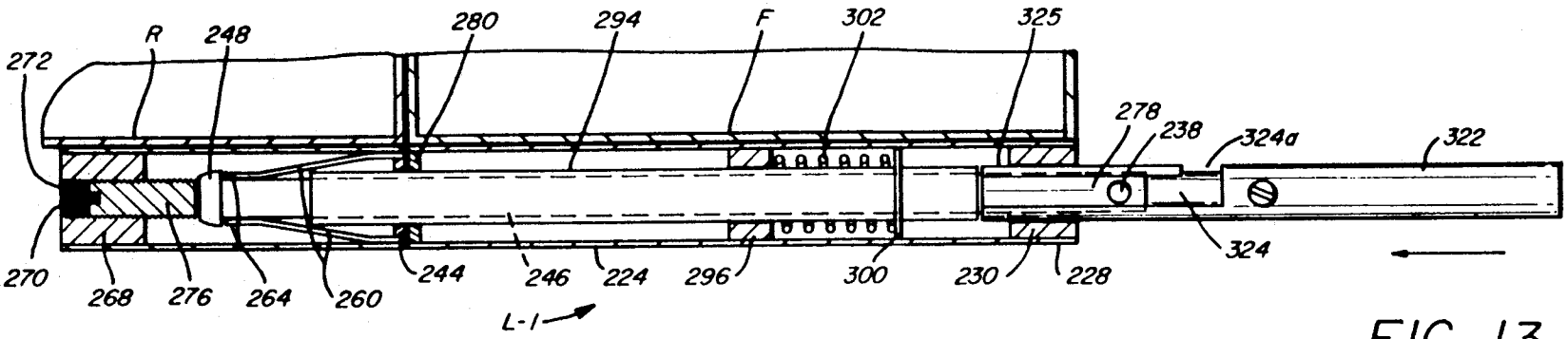

The lock L-1 is shown in the unlocked position in FIG. 10. The lock L-1 is locked by applying force to the front end 278 of the lock rod 246 in the direction of the rear housing 226. The locking head 248 spread the blade ends 264 of blades 260 as the locking head 248 passes therethrough. When the locking head 248 has passed by the blade ends 264, the blade ends 264 converge and contact the inner face 256 of the locking head 248 (FIG. 13). The threaded member 276 can be adjusted to restrict the further advancement of locking head 246 towards the back plate 268 of the rear housing 226. Adjustment of the threaded member 276 is normally only required one time, that being during installation of the lock L-1.

The lock L-1 is locked when the locking head 246 is engaged by the spring steel blades 260 after passing them (FIG. 13). A conventional seal S is inserted through the aperture 238 in the front end 278 of the locking rod 246.

Figure 12:
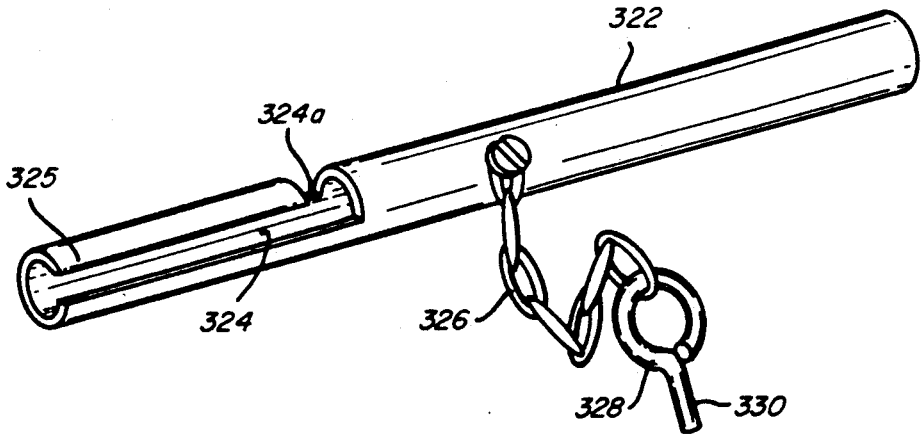
FIG. 12 is an isometric view of a key mechanism used with the meter box lock of FIGS. 10, 11, 13, 14 and 15.

Unlocking of lock L-1 involves removal of the conventional seal S and then utilizing an unlocking tool 322 as shown in FIG. 12. The unlocking tool 322 is a hollow tubular member of the same general diameter as the unlocking slide sleeve 294. One end of the tool 322 has a longitudinal slot 324 cut through its side wall. The end of the longitudinal slot 324 is notched as shown at 324*a* to form an L-shaped slot. The unlocking tool 322 is additionally shown in FIG. 12 with a chain 326 connecting a key 328 to the tool 322. The key 328 has an end 330 which can be inserted into the opening 238 of the locking rod 246.

Figure 14:
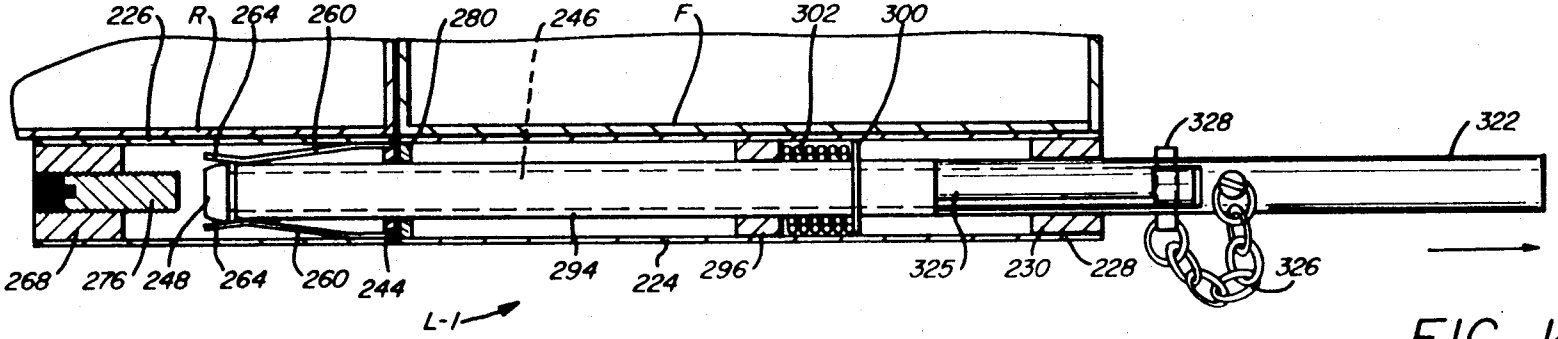
Figure 15:
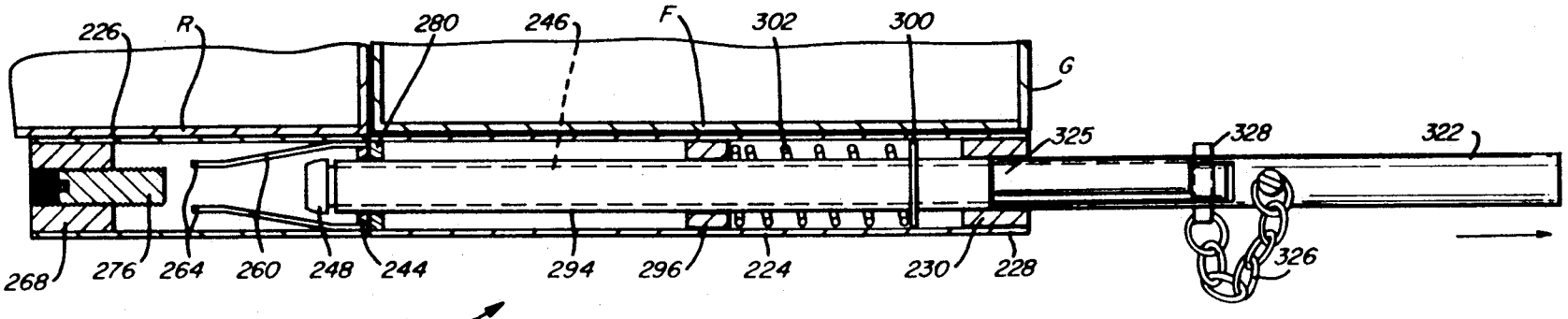

The unlocking procedure of lock L-1 is illustrated in FIGS. 13–15. After the seal S has been removed, the slotted end 324 of the unlocking tool 322 is inserted over the front end 278 of the locking rod 246 until the slotted end 324 abuts the unlocking slide sleeve 294. The key 328 is inserted in the opening 238 of the locking rod 246. The operator applies force to the tool 322 in the direction of the rear housing 226 causing the unlocking slide sleeve 294 to advance towards the locking head 248. On making contact with the locking head 248, the spring steel blades 260 are disengaged from around the head 248. With one hand on the key 328 and the other hand on the tool 322, the operator rotates the tool 322 so that the key 328 is positioned in the short leg of the L-shaped slot 324. The sleeve retraction spring 302, which has been compressed during the inward movement of the slide sleeve 294, forces the slide sleeve 294 and the locking rod 246 away from the rear housing 226. The lock L-1 is now unlocked and the tool 322 and key 328 may then be removed from the locking rod 246.

The foregoing disclosure and description of the invention are illustrative and explanatory thereof, and various changes in the size, shape and materials, as well as in the details of the illustrated construction may be made without departing from the spirit of the invention.

We claim:

1. A lock for an electrical power meter box in a housing assembly mounted with the meter box and having a front housing and a rear housing, comprising:

a) lock rod means having a head on a rear end thereof and mounted in said front housing of the housing assembly;

b) lock rod receiving means mounted in said rear housing of the housing assembly, said lock rod receiving means being formed of blade members for engaging with said lock rod head and passing same inwardly to a locked position while restricting withdrawal outwardly of said lock rod head from the locked position;

c) rod stopping means mounted in said rear housing for contact with said lock rod head when in the locked position, said rod stopping means comprising a stop adapted for travel longitudinally in said rear housing;

d) a stop spring urging said stop resiliently toward said lock rod receiving means;

e) said stop spring urging said stop into engagement with said lock rod head and holding said lock rod head between said stop and said blade members when in the locking position; and f) unlocking means for releasing said lock rod head from said lock rod receiving means to an unlocked position.

2. The lock of claim 1, wherein said blade members of said lock rod receiving means comprise spring steel blades.

3. The lock of claim 1, wherein said unlocking means includes;

a tube mounted in said front housing surrounding said lock rod means and adapted to move from said front housing into said rear housing to engage said lock rod head to release said lock rod head from said blade members of said lock rod receiving means.

4. The lock of claim 3, wherein said tube comprises: means for sliding along said lock rod means and disengaging said blade members from around said lock rod head.

5. The lock of claim 4, wherein said unlocking means includes a spring mounted in said front housing about said tube to return said tube to the unlocked position after disengaging contact of said tube with said lock rod head of said lock rod means.

6. The lock of claim 1, wherein said front housing substantially contains said lock rod means in the unlocked position.

7. A lock for an electrical power meter box in a housing assembly mounted with the meter box and having a front housing an a rear housing, comprising:

a) lock rod means having a head on a rear end thereof and mounted in said front housing of the housing assembly;

b) lock rod receiving means mounted in said rear housing of the housing assembly, said lock rod receiving means being formed of blade members for engaging with said lock rod head and passing same inwardly to a locked position while restricting withdrawal outwardly of said lock rod head from the locked position;

c) rod stopping means mounted in said rear housing for contact with said lock rod head when in the locked position, said rod stopping means comprising a member threadedly advanced into said rear housing;

d) said threaded member engaging said lock rod head and resisting further advancement of said lock rod head in the locking position; and e) unlocking means for releasing said lock rod head from said lock rod receiving means to an unlocked position.

* * * * *